US011606640B2

(12) United States Patent
Sauer et al.

(10) Patent No.: US 11,606,640 B2
(45) **Date of Patent: *Mar. 14, 2023**

(54) COATING FOR IMPROVING LOUDSPEAKER SOUND QUALITY

(71) Applicant: Apple Inc., Cupertino, CA (US)

(72) Inventors: Juergen Sauer, Munich (DE); Veronika Wagner, Munich (DE)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/368,140

(22) Filed: Jul. 6, 2021

(65) Prior Publication Data

US 2021/0337304 A1 Oct. 28, 2021

Related U.S. Application Data

(63) Continuation of application No. 16/681,381, filed on Nov. 12, 2019, now Pat. No. 11,109,150.

(51) Int. Cl.
*H04R 1/28* (2006.01)
*H04R 1/02* (2006.01)

(52) U.S. Cl.
CPC ..... *H04R 1/288* (2013.01); *H04R 1/025* (2013.01)

(58) Field of Classification Search
None
See application file for complete search history.

(56) References Cited

U.S. PATENT DOCUMENTS

| | | | | |
|---|---|---|---|---|
| 10,118,153 | B1 * | 11/2018 | Jin | B01J 20/22 |
| 11,109,150 | B2 * | 8/2021 | Sauer | H04R 1/288 |
| 2016/0345090 | A1 * | 11/2016 | Wilk | B01D 53/04 |
| 2017/0173862 | A1 * | 6/2017 | Lin | C08J 9/42 |
| 2020/0031678 | A1 * | 1/2020 | Feng | C01B 39/023 |

FOREIGN PATENT DOCUMENTS

CN 109110781 1/2019

OTHER PUBLICATIONS

Notice of Preliminary Rejection for Korean Application No. 10-2020-0150228 dated Sep. 20, 2021, 15 pages.

* cited by examiner

*Primary Examiner* — Walter F Briney, III
(74) *Attorney, Agent, or Firm* — Womble Bond Dickinson (US) LLP

(57) ABSTRACT

Aspects are disclosed of an acoustically active coating. The coating is a porous coating having a thickness and including between 2% and 30% by mass of a binder and between 70% and 98% by mass of a zeolite. The coating comprises a plurality of convex shapes connected by concave connectors and has a distribution of pore sizes. Other embodiments are disclosed and claimed.

23 Claims, 13 Drawing Sheets

COATING FOR IMPROVING LOUDSPEAKER SOUND QUALITY

CROSS-REFERENCE TO RELATED APPLICATIONS

This application is a continuation under 35 U.S.C. § 120 of U.S. application Ser. No. 16/681,381, filed 12 Nov. 2019 and still pending.

TECHNICAL FIELD

The disclosed aspects relate generally to audio loudspeakers and in particular, but not exclusively, to a coating that improves loudspeaker sound quality and to audio loudspeakers that use the coating in their back volumes to improve loudspeaker performance.

BACKGROUND

Loudspeakers typically include a back volume and a membrane or diaphragm that oscillates and emits sound when driven by an electromagnetic transducer. A variety of different forces act on the membrane while it is being moved, distorting its intended acceleration by the electromagnet and thus distorting the sound waves it emits. Reduction of these additional membrane forces leads to improved sound quality.

One of the forces acting on the membrane results from pressure fluctuations in the back volume due to compression and decompression by the moving membrane of air in the back volume. These pressure fluctuations can be reduced by increasing the space of the back volume—e.g., by making it larger. But in hand-held devices such as cell phones, increasing the size of the back volume is possible only to a minor degree because these devices should be kept conveniently small.

SUMMARY

Aspects are described of an audio speaker. The audio speaker includes a housing defining a back volume behind a speaker driver, so that the speaker driver can convert an electrical audio signal into a sound and the sound can propagate through a gas in the back volume. A highly porous acoustically active coating is deposited on at least one interior surface of the back volume, the highly porous coating including a binder and an adsorptive substance.

Aspects are described of an acoustically active coating. In one aspect the coating is a highly porous coating having a thickness and including between 2% and 30% by mass of a binder and between 70% and 98% by mass of a zeolite. The coating comprises an irregular matrix formed by a plurality of convex shapes connected by concave connectors and has a distribution of pore sizes. Other embodiments are disclosed and claimed.

Aspects are described of a process including preparing a slurry including a binder and a zeolite. The slurry is sprayed through a nozzle having a nozzle diameter. A highly porous acoustically active coating is deposited on a substrate by directing the sprayed slurry through an environment onto the substrate, the substrate being positioned at a distance from the nozzle.

BRIEF DESCRIPTION OF THE DRAWINGS

Non-limiting and non-exhaustive aspects of the present invention are described with reference to the following figures, wherein like reference numerals refer to like parts throughout the various views unless otherwise specified.

DETAILED DESCRIPTION

The disclosure below describes aspects of a loudspeaker including a back volume with an acoustically active coating on at least one of its interior walls. As used herein, the term "acoustically active coating" refers to a coating that, through physical mechanisms such as adsorption, can adsorb or desorb gases and as a result has acoustic properties that, when the coating is used in a loudspeaker back volume, can cause the back volume to behave as if it is bigger than it actually is, so that the acoustically active coating improves the loudspeaker's sound quality. Specific details are described to provide an understanding of the disclosed aspects, but one skilled in the art will recognize that the invention can be practiced without one or more of the described details or with other methods, components, materials, etc. In some instances, well-known structures, materials, or operations are not shown or described in detail but are nonetheless encompassed within the scope of the invention.

Reference throughout this specification to "one aspect" or "an aspect" means that a described feature, structure, or characteristic can be included in at least one described aspect, so that appearances of "in one aspect" or "in an aspect" do not necessarily all refer to the same aspect. Furthermore, the particular features, structures, or characteristics can be combined in any suitable manner in one or more aspects.

One approach to reducing back volume pressure fluctuations for handheld devices is to place adsorbent materials like carbon black or zeolites into the back volumes. It has been shown that such materials can virtually increase the back volume—in other words, their presence in the back volume enhances loudspeaker performance as if the speaker's back volume had been made physically bigger.

Loudspeaker

Figure 1:
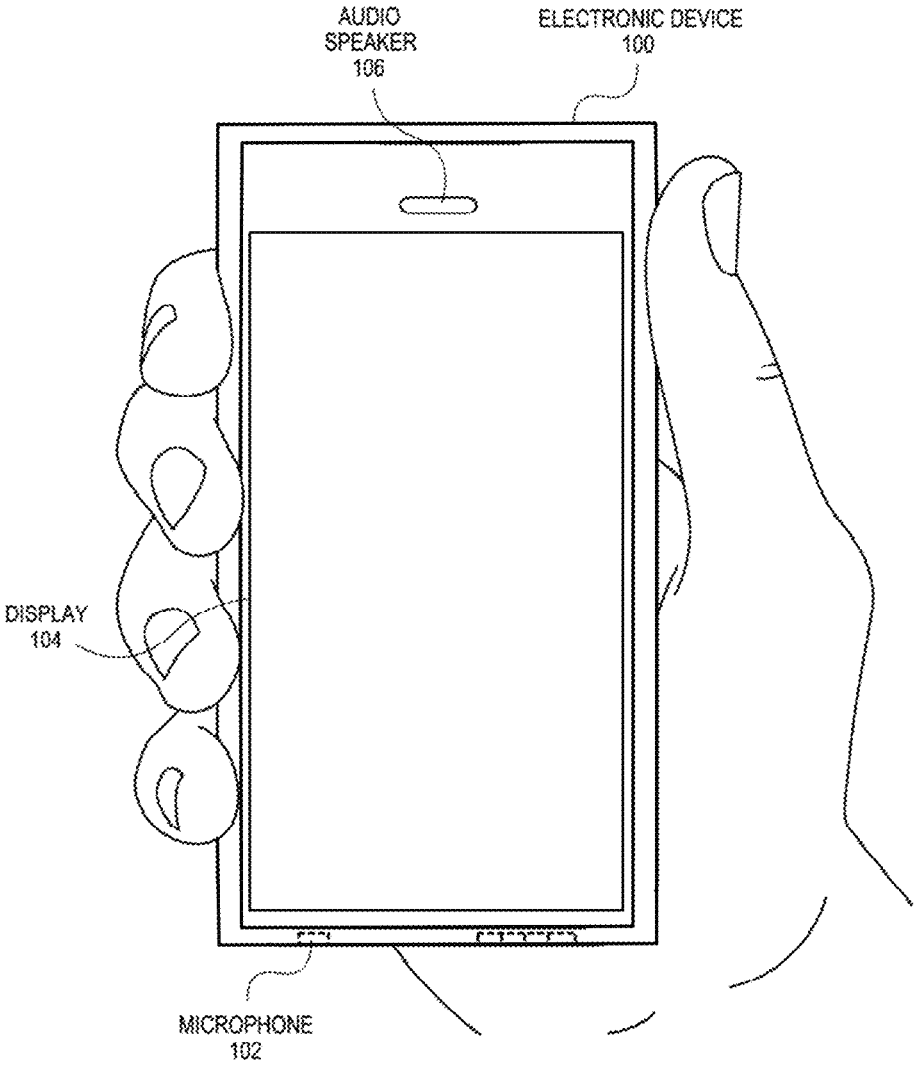
FIG. 1 is a pictorial view of an aspect of an electronic device.

FIG. 1 illustrates an aspect of an electronic device 100. Electronic device 100 can be a smartphone device in one aspect, but in other aspects can be any other portable or stationary device or apparatus, such as a laptop computer or a tablet computer. Electronic device 100 can include various capabilities to allow the user to access features involving, for example, calls, voicemail, music, e-mail, internet browsing, scheduling, and photos. Electronic device 100 can also include hardware to facilitate such capabilities. For example, an integrated microphone 102 can pick up the voice of a user during a call, and an audio speaker 106, e.g., a micro loudspeaker, can deliver a far-end voice to the near-end user during the call. Audio speaker 106 can also emit sounds associated with music files played by a music player application running on electronic device 100. A display 104 can present the user with a graphical user interface to allow the user to interact with electronic device 100 and/or applications running on electronic device 100. Other conventional features are not shown but can of course be included in electronic device 100.

FIGS. 2A-2D illustrate aspects of an audio speaker of an electronic device. In an aspect, an audio speaker 106 includes an enclosure, such as a speaker housing 204, which supports a speaker driver 202. Speaker driver 202 can be a loudspeaker used to convert an electrical audio signal into a sound. For example, speaker driver 202 can be a micro speaker having a diaphragm 206 supported relative to housing 204 by a speaker surround 208. Speaker surround 208 can flex to permit axial motion of diaphragm 206 along a central axis 210. For example, speaker driver 202 can have a motor assembly attached to diaphragm 206 to move diaphragm 206 axially with piston-like motion, i.e., forward and backward, along central axis 210. The motor assembly can include a voice coil 212 that moves relative to a magnetic assembly 214. In an aspect, magnetic assembly 214 includes a magnet, such as a permanent magnet, attached to a top plate at a front face and to a yoke at a back face. The top plate and yoke can be formed from magnetic materials to create a magnetic circuit having a magnetic gap within which voice coil 212 oscillates forward and backward. Thus, when the electrical audio signal is input to voice coil 212, a mechanical force can be generated that moves diaphragm 206 to radiate sound forward along central axis 210 into a surrounding environment outside of housing 204.

Movement of diaphragm 206 to radiate sound forward toward the surrounding environment can cause sound to be pushed in a rearward direction. For example, sound can propagate through a gas filling a space enclosed by housing 204. More particularly, sound can travel through air in a back volume 216 behind diaphragm 206. Back volume 216 can influence acoustic performance. In particular, the size of back volume 216 can influence the natural resonance peak of audio speaker 106. For example, increasing the size of back volume 216 can result in the generation of louder bass sounds.

In an aspect, back volume 216 within housing 204 can be separated into several cavities. For example, in one aspect back volume 216 can be separated by a permeable partition 222 into a rear cavity 218 and an adsorption cavity 220 (see FIG. 2A), although other aspects need not have permeable partition 222 at all, in which case back volume 216 can be a single cavity instead of multiple cavities (see FIG. 2B). Rear cavity 218 can be located directly behind speaker driver 202. That is, speaker driver 202 can be suspended or supported within rear cavity 218 so that sound radiating backward from diaphragm 206 propagates directly into rear cavity 218. Accordingly, at least a portion of rear cavity 218 can be defined by a rear surface of diaphragm 206, and similarly, by a rear surface of speaker surround 208. Furthermore, given that permeable partition 222, if present, can extend across a cross-sectional area of back volume 216 between several walls of housing 204, rear cavity 218 can be further defined by an internal surface of housing 204 and a first side 224 of permeable partition 222.

In aspects in which it is separated into multiple cavities (e.g., FIG. 2A), back volume 216 can include adsorption cavity 220 separated from rear cavity 218 by permeable partition 222—i.e., adsorption cavity 220 can be adjacent to rear cavity 218 on an opposite side of permeable partition 222. In an aspect, adsorption cavity 220 is defined by an internal surface of housing 204 that surrounds back volume 216, and can also be defined by a second side 226 of permeable partition 222, if present. Thus, rear cavity 218 and adsorption cavity 220 can be immediately adjacent to one another across permeable partition 222. In aspects where permeable partition 222 is not present, rear cavity 218 and adsorption cavity 220 together form a single back volume 216 (e.g., FIG. 2B).

Audio speaker 106 can have a form factor with any number of shapes and sizes. For example, audio speaker 106, and thus housing 204, can have an external contour that appears to be a combination of hexahedrons, cylinders, etc. One such external contour could be a thin box, for example. Furthermore, housing 204 can be thin-walled, and thus, a cross-sectional area of a plane passing across housing 204 at any point can have a geometry corresponding to the external contour, including rectangular, circular, and triangular, etc. Accordingly, if present, permeable partition 222 extending across back volume 216 within housing 204 can also have a variety of profile shapes. For example, in the case where audio speaker 106 is a hexahedron, e.g., a low-profile box having a rectangular profile extruded in a direction orthogonal to central axis 210, permeable partition 222 can have a rectangular profile.

Acoustically active adsorptive coating 232 can be packaged in adsorption cavity 220 by forming the coating on at least one inner surface of housing 204 with an acoustically active coating as further described below. Adsorptive coating 232 can be any adsorptive coating that is capable of adsorbing a gas located in back volume 216. For example, adsorptive coating 232 can be any of the highly porous adsorption coatings described below in connection with FIG. 4 et seq., which are configured to adsorb air molecules. In aspects without a permeable partition, adsorptive coating 232 can be formed anywhere in back volume 216.

Figure 2A:
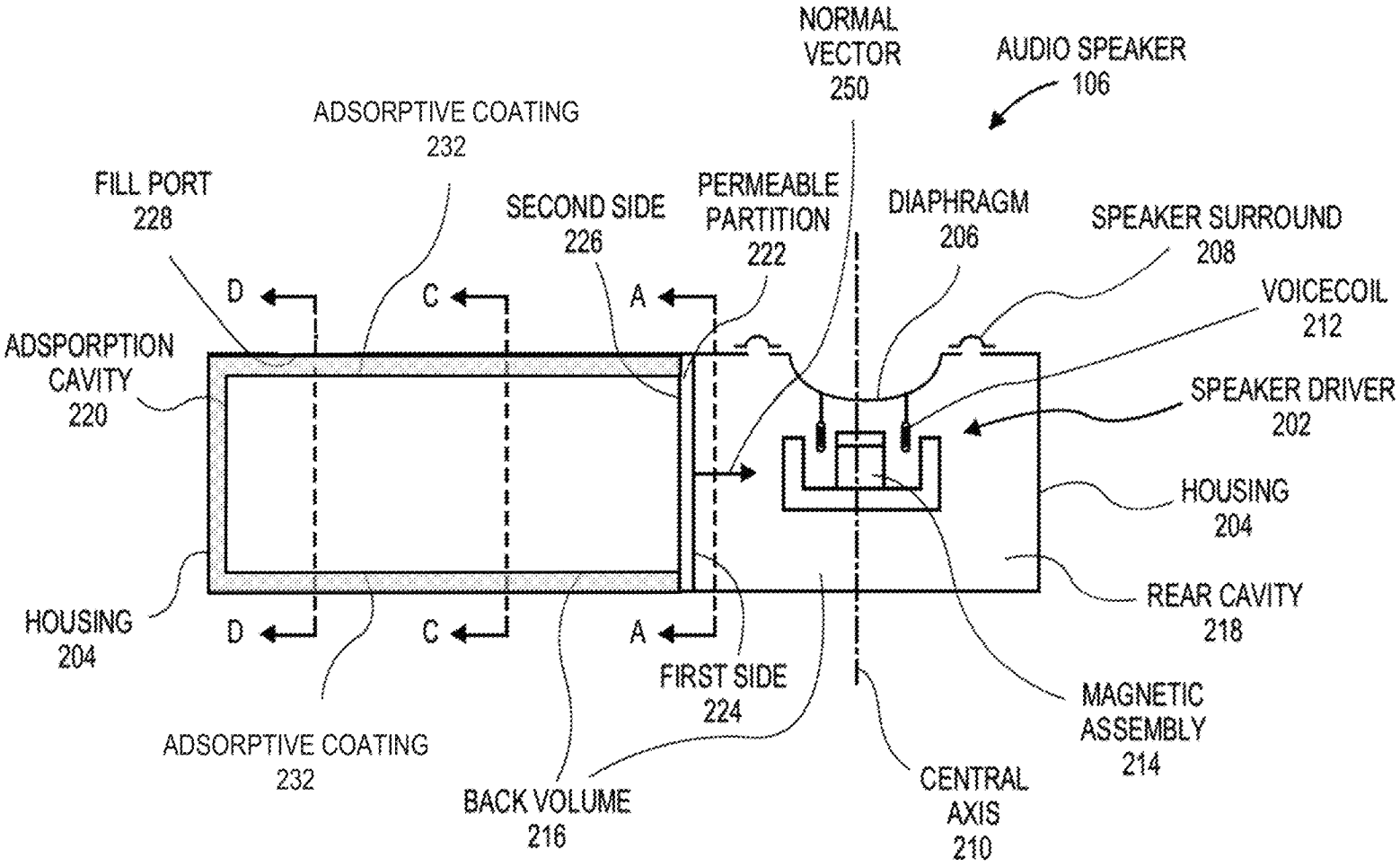
FIGS. 2A-2D are sectional views of aspects of an audio micro-loudspeaker for an electronic device.
Figure 2B:
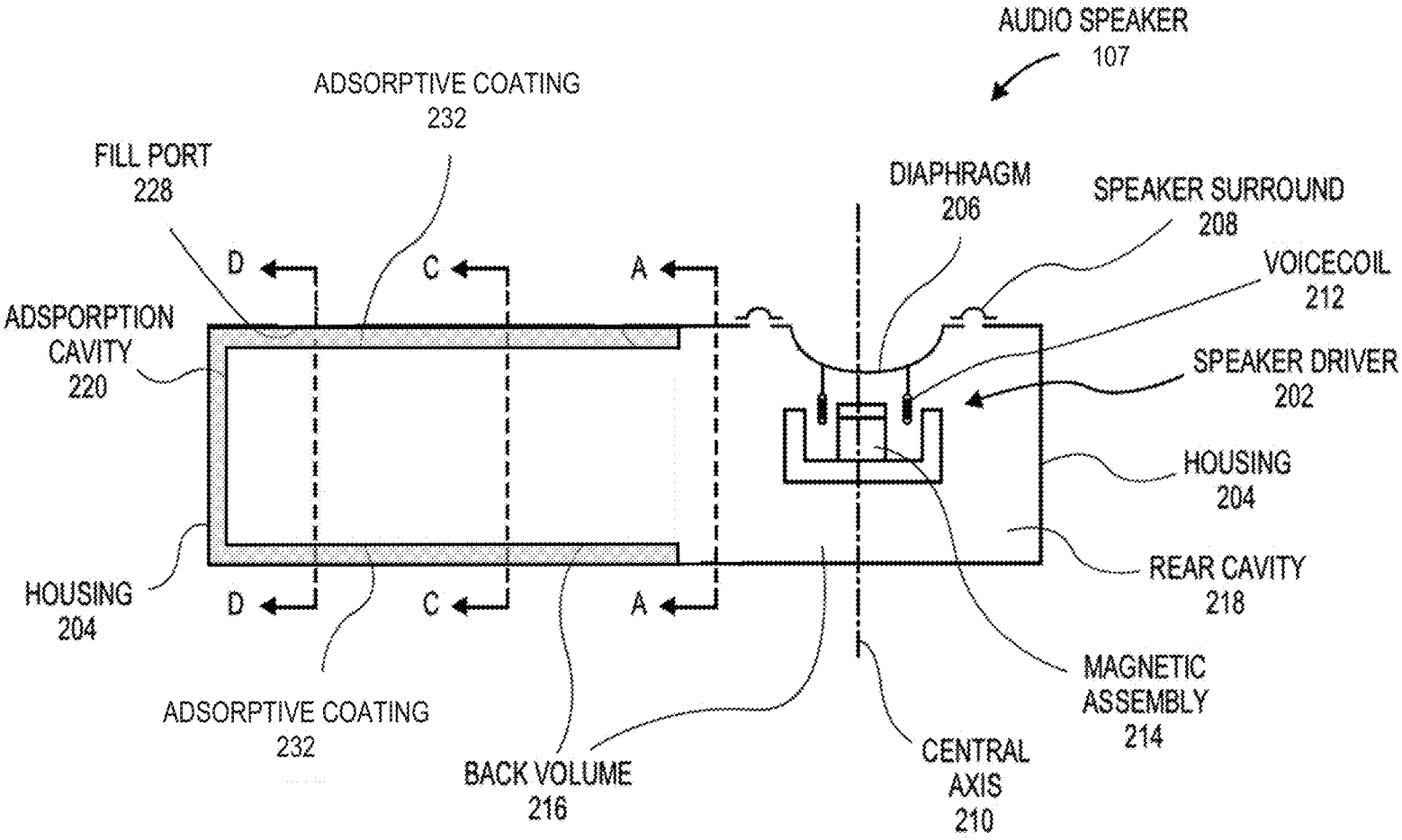
Figure 2C:
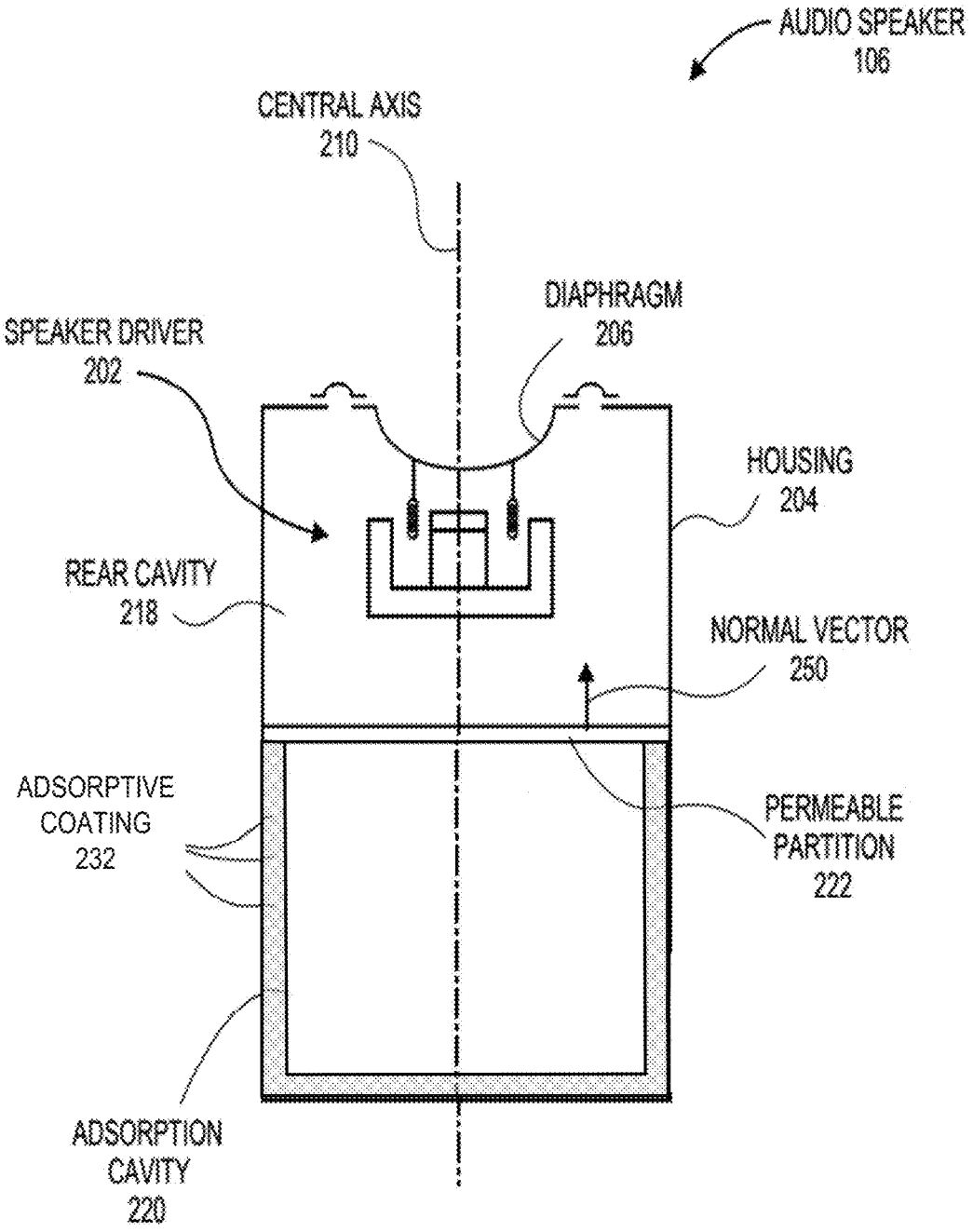
Figure 2D:
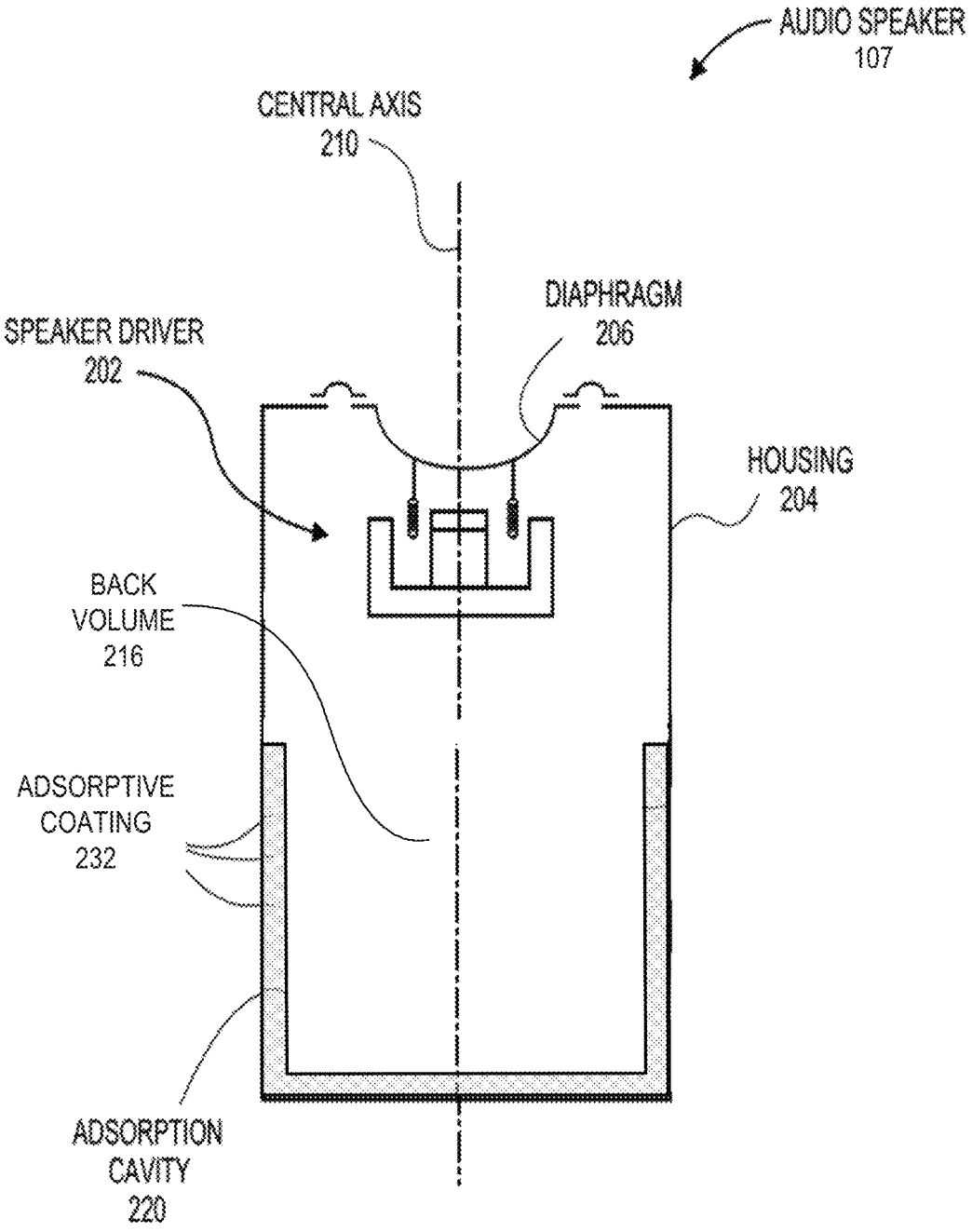

FIGS. 2C-2D illustrate another aspect of an audio loudspeaker of an electronic device. Rear cavity 218 and adsorption cavity 220 can have different relative orientations in various aspects. For example, in the aspect shown in FIG. 2A, adsorption cavity 220 is located lateral to rear cavity 218, i.e., is laterally offset from rear cavity 218 away from central axis 210. As a result, sound emitted rearward from diaphragm 206 can propagate directly toward a rear wall of rear cavity 218, rather than be radiated directly toward permeable partition 222.

But in the aspect shown in FIG. 2C, audio speaker 106 includes axially arranged back volume 216 cavities. For example, adsorption cavity 220 can be located directly behind rear cavity 218, so that central axis 210 can intersect rear cavity 218 behind diaphragm 206 and adsorption cavity 220 on an opposite side of permeable partition 222. Accordingly, permeable partition 222 can cross back volume 216 along a plane such that normal vector 250 emerging from first side 224 and pointing into rear cavity 218 is oriented in a direction that is parallel to central axis 210. For example, rear cavity 218 and adsorption cavity 220 can each be flat and thin and positioned forward-and-behind along central axis 210. Thus, sound emitted rearward by diaphragm 206 can propagate along central axis 210 directly through rear cavity 218 and permeable partition 222 into adsorption cavity 220.

As with the aspect shown in FIG. 2A, the aspect of FIG. 2C need not include permeable partition 222, in which case its back volume 216 is a single cavity (see FIG. 2D). But if present, permeable partition 222 can be oriented at any angle relative to central axis 210. That is, although first face can face a direction orthogonal to, or parallel to, central axis 210, in an aspect, permeable partition 222 is oriented at an oblique angle relative to central axis 210. Thus, adsorption cavity 220 can be some combination of lateral to, or directly behind, adsorption cavity 220 within the scope of this description. In any case, rear cavity 218 and adsorption cavity 220 can be adjacent to one another such that opposite sides of permeable partition 222 define a portion of each cavity. Acoustically active adsorption coating 232 can be formed on at least one surface of at least one wall of adsorption cavity 220, similarly to the aspect of FIG. 2A.

Figure 3:
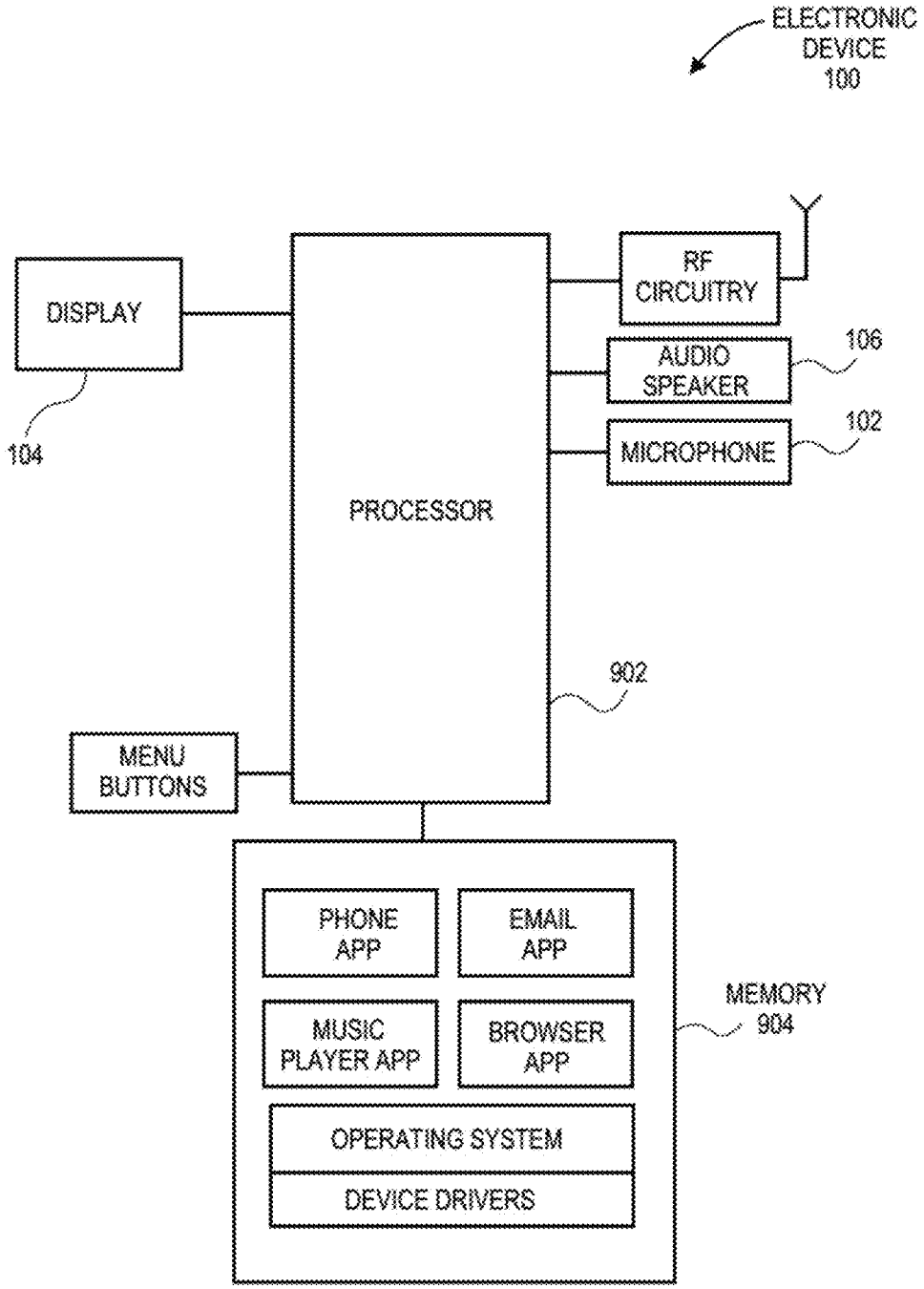
FIG. 3 is a schematic block diagram of an aspect of an electronic device including an aspect of an audio micro-speaker such as the ones shown in FIGS. 2A-2D.

FIG. 3 schematically illustrates an aspect of an electronic device that includes a micro speaker. As described above, electronic device 100 can be one of several types of portable or stationary devices or apparatuses with circuitry suited to specific functionality. Thus, the diagrammed circuitry is provided by way of example and not limitation. Electronic device 100 can include one or more processors 902 that execute instructions to carry out the different functions and capabilities described above. Instructions executed by the one or more processors 902 of electronic device 100 can be retrieved from local memory 904, and can be in the form of an operating system program having device drivers, as well as one or more application programs that run on top of the operating system, to perform the different functions introduced above, e.g., phone or telephony and/or music play back. For example, processor 902 can directly or indirectly implement control loops and provide drive signals to voice coil 212 of audio speaker 106 to drive diaphragm 206 motion and generate sound.

Audio speaker 106 with the structure described above can include back volume 216 separated by an acoustically transparent barrier—e.g., permeable partition 222, if present—into two cavities: rear cavity 218 directly behind speaker driver 202 and adsorption cavity 220 adjacent to rear cavity 218 across permeable partition 222. Other aspects of audio speaker 106 with adsorptive coating 232 can have a back volume 216 that is a single cavity—i.e., one in which there is no permeable partition 222. Furthermore, adsorption cavity 220 can be directly filled with an adsorptive material such that back volume 216 includes an adsorptive volume defined directly between a system housing 204 and the acoustically transparent barrier. The adsorptive volume can reduce the overall spring rate of back volume 216 and lower the natural resonance peak of audio speaker 106. That is, adsorptive coating 232 can adsorb and desorb randomly traveling air molecules as pressure fluctuates within back volume 216 in response to a propagating sound. As a result, audio speaker 106 can have a higher efficiency at lower frequencies, as compared to a speaker having a back volume 216 without adsorptive material. Thus, the overall output power of audio speaker 106 can be improved. More particularly, audio speaker output can be louder during telephony or music play back, especially within the low-frequency audio range. Accordingly, audio speaker 106 having the structure described above can produce louder, richer sound within the bass range using the same form factor as a speaker back volume without multiple cavities, or can produce equivalent sound within the bass range within a smaller form factor. Furthermore, because adsorption cavity 220 is defined directly between housing 204 and permeable partition 222, which are sealed together, the form factor of audio speaker 106 can be smaller than, e.g., a speaker back volume that holds a secondary container, e.g., a mesh bag, filled with an adsorbent material.

Back-Volume Configurations with Acoustically Active Lining

Orientation-independent sound quality in a loudspeaker can be achieved by using an immobilized formulation such as a fixed coating comprising an adsorbent material like a zeolite, sticking to the walls of the back volume of a loudspeaker. But simple coating techniques do not result in acoustically active coatings—i.e., in an improved sound quality. Such conventional coating techniques yield a dense, non-porous coating, whereas an acoustical active coating usually is a highly porous structure. But, surprisingly, such a porous coating can be made by applying a technique in which atomized droplets are partly dried during flight before they hit a substrate. By numerous experiments it was found that especially aqueous slurries comprising a zeolite and a binder form porous but nevertheless mechanically stable coatings which are acoustically active—that is, they improve loudspeaker sound quality. A good measure for the sound quality is the position of the resonance peak of an electrical impedance measurement. The lower the frequency of maximum electrical impedance, the more output in the low frequency region can be obtained by the loudspeaker. A high output in the low frequency region is especially desirable for micro speakers.

Figure 4:
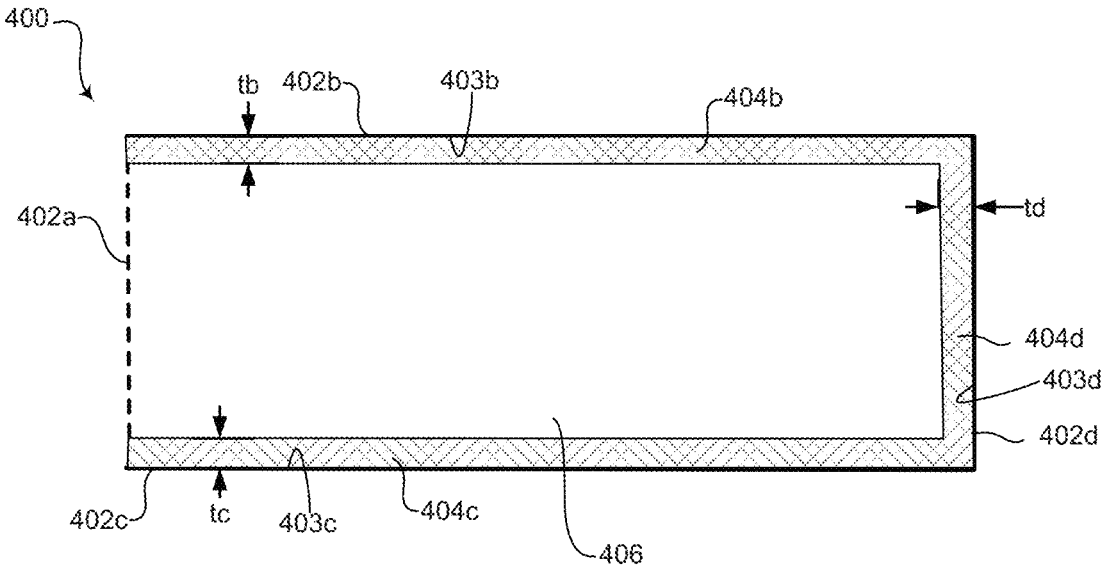
FIG. 4 is a cross-sectional view of an aspect of an audio micro-loudspeaker back volume, such as the ones shown in FIGS. 2A-2D, with an acoustically active coating on at least one wall of the back volume.

FIG. 4 illustrates an aspect of a back volume 400 having an acoustically active coating applied to at least one of its interior walls. Back volume 400 is a three-dimensional space bounded by a plurality of walls 402*a*-402*d*. Each of walls 402*b*-402*d* has an interior surface 403: wall 402*b* has interior surface 403*b*, wall 402*c* has interior surface 403*c*, and wall 402*d* has interior surface 403*d*. In the illustrated aspect one of the walls, wall 402*a* in this instance, is porous so as to allow gas to flow in and out of the back volume, but in other aspects wall 402*a* can be omitted entirely. In the illustrated aspect back volume 400 is a regular hexahedron, but in other aspects it can be some other type of polyhedron, regular or irregular. In still other aspects, back volume 400 need not be a polyhedron, but can instead be made up of a combination of curved surfaces, plane surfaces, or both.

At least one interior surface 403 of back volume 400 is at least partially coated with an acoustically active coating 404, which can be any of the acoustically active coatings described below. The illustrated aspect has acoustically active layers 404 deposited on multiple interior surfaces: layer 404*b* is deposited on interior surface 403*b*, layer 404*c* is deposited on interior surface 403*c*, and layer 404*d* is deposited on interior surface 403*d*. Because wall 402*a* is porous, no layer 404 is deposited on its interior surface because it would prevent the flow of gas into and out of back volume 400. In an aspect in which wall 402*a* is not present, there would of course be no layer 404 on it. In other aspects, layers 404 can be positioned on a greater or lesser number of interior surfaces 403 than shown, ranging from a single interior surface to every interior surface of the back volume except the interior surface of the back volume's porous wall. In the illustrated aspect each coating 404*b*-404*d* has a uniform thickness t: coating 404*b* has uniform thickness tb, coating 404*c* has uniform thickness tc, and so on. But other aspect need not have coatings of uniform thickness. In one aspect layers 404*b* and 404*c* could be tapered—for instance, thinner adjacent to porous wall 402*a* and getting thicker toward wall 402*d*. The taper could be a smooth, continuous taper or a taper made up of discrete steps.

Acoustically Active Coating Forming Process

Figure 5:
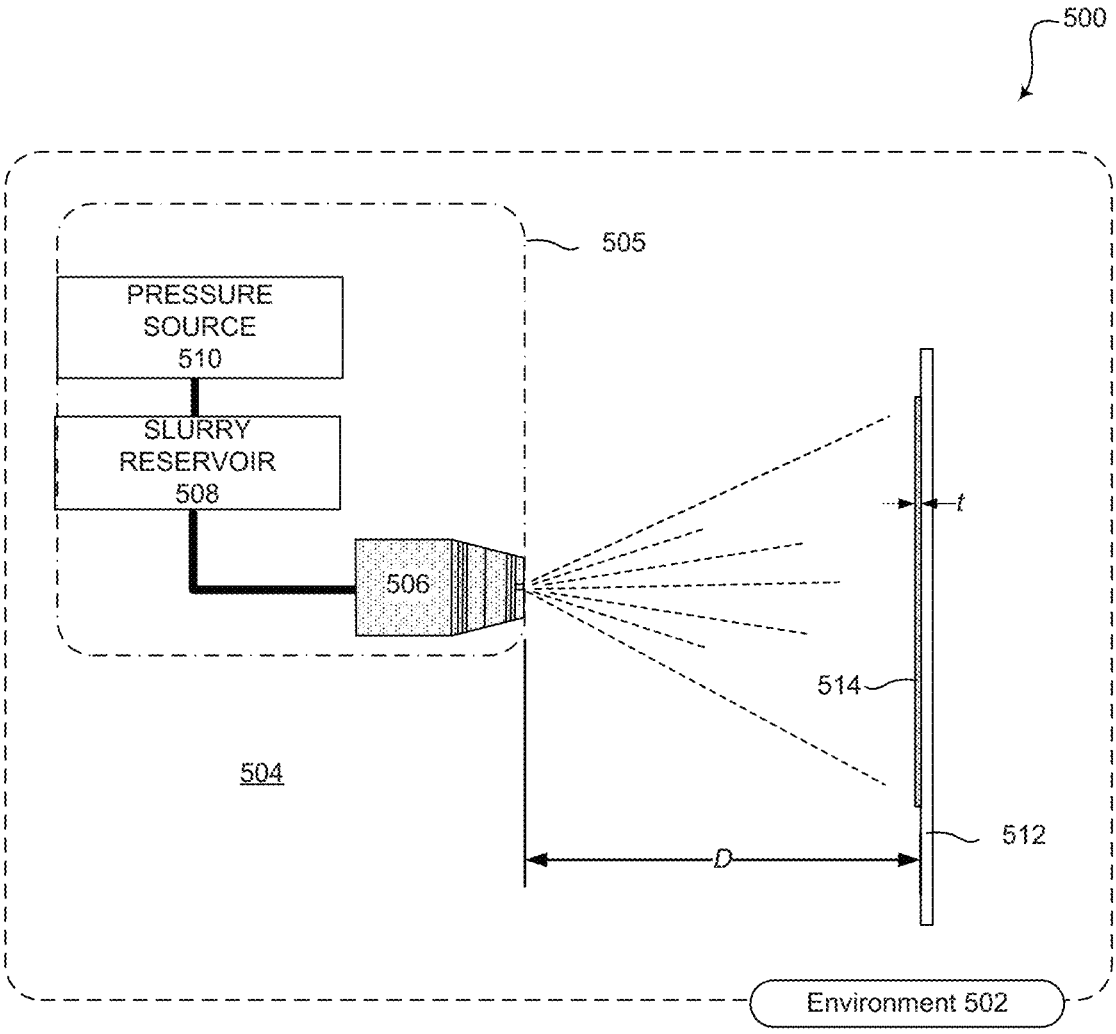
FIG. 5 is drawing of an aspect of a hardware setup used to implement a process such as the one shown in FIG. 6 for forming an acoustically active coating on a wall of a loudspeaker back volume.
Figure 6:
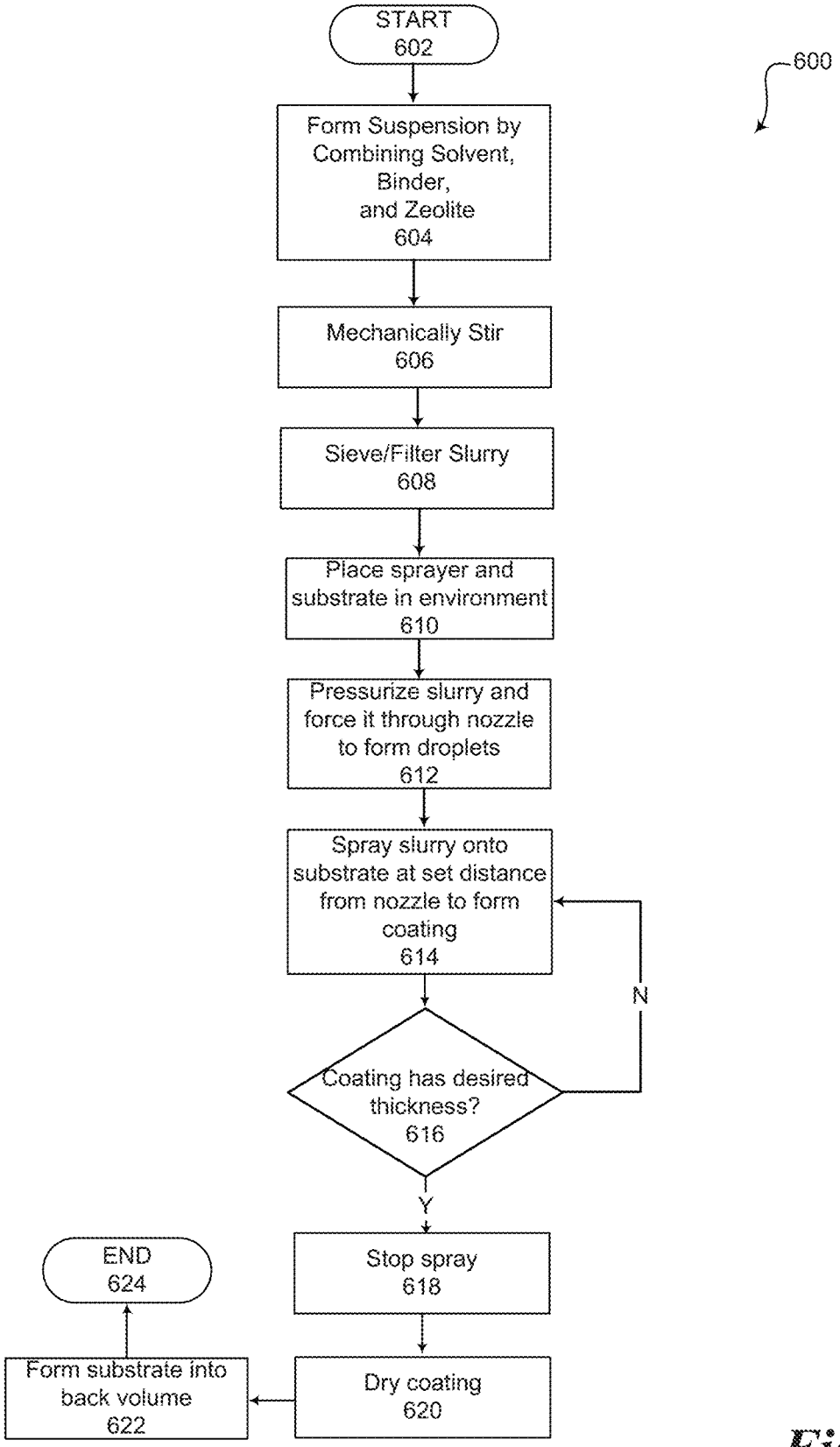
FIG. 6 is a flowchart of an aspect of a process for forming an acoustically active coating on a wall of a loudspeaker back volume as shown in FIG. 5.

FIGS. 5-6 together illustrate a process for forming an acoustically active coating on a surface of a substrate such as the wall of a back volume; FIG. 5 illustrates an aspect of hardware that can be used, while FIG. 6 illustrates an embodiment of the process in flowchart form.

FIG. 5 illustrates an aspect of a system 500 for forming an acoustically active coating. System 500 includes an environment 502 with an interior 504. In one aspect environment 502 can be an enclosed space such as a room in a building, but in other aspects it can be a subset of a room or a specially-constructed enclosure such as a large box or cabinet. During operation of the process the interior 504 is kept at a known temperature, pressure, and relative humidity. In one aspect, interior 504 can be kept at standard temperature and pressure (STP), for instance the US National Institute of Standards and Technology (NIST) STP, which is a temperature of 20° C. (293.15 K, 68° F.) and an absolute pressure of 1 atmosphere (14.696 psi, 101.325 kPa). This standard is sometimes also called normal temperature and pressure (NTP). In other aspects the temperature, the pressure, or both, can be different than STP. The relative humidity in interior 504 can be varied from 20% to 100% or in any subrange thereof, such as 40% to 70%. Different formulations of the slurry in slurry reservoir 508 can use different temperatures, pressures, and/or relative humidities to obtain the desired properties in the resulting acoustically active coating. And the reverse can be true too: different environmental conditions can use different slurry formulations.

A sprayer 505 is positioned in the interior 504 of environment 502. The sprayer includes a nozzle 506 that is fluidly coupled to a slurry reservoir 508 so that slurry can flow from the reservoir to the nozzle. In one aspect sprayer 505 can be a commercially available device such as an air brush or spray-painting gun. In another aspect, an oscillating nozzle can be used to enhance atomization of the slurry. If it is an oscillating nozzle, nozzle 506 can be made to vibrate at one or more frequencies, for instance by using an amplifier connected to a function generator. A pressure source 510 is fluidly coupled to slurry reservoir 508 to push the slurry to nozzle 506 and out of the nozzle. In one aspect, pressure source 510 can be an air compressor, high-pressure air tank, or other source of high-pressure air that can be fluidly coupled to slurry reservoir 508.

A substrate 512 is positioned in interior 504 of environment 502 at a distance D from the outlet of nozzle 506. In various aspects, distance D can vary between 10 cm and 100 cm or any subrange thereof, such as 15-20 cm. Distances D outside this range—i.e., smaller than 10 cm or greater than 100 cm—are of course possible in other aspects. In some aspects distance D can be adjusted depending on the composition of the slurry, the pressure in pressure source 510, and the environmental conditions in interior 504 of environment 502. In other aspects the adjustment can be made the other way: the environmental conditions in interior 504 can be adjusted depending on distance D.

In operation, slurry from slurry reservoir 508 is sprayed through nozzle 506 toward substrate 512, such that the sprayed slurry reaches a surface of substrate 512. As the slurry is sprayed on to the surface of substrate 512, it at least partially dries between the nozzle and the substrate, and when it hits the substrate it accumulates (i.e., it is deposited) until a layer of slurry 514 of desired thickness tis deposited on substrate 512. The drying rate of the sprayed slurry can be controlled, for instance, by varying the composition of the slurry, the pressure in pressure source 510, and the environmental conditions (temperature, pressure, and relative humidity) in interior 504. The final thickness t of acoustically active coating 514 depends on a tradeoff between mechanical robustness and adsorption/desorption properties: a thin coating (small t) is more mechanically robust and has less favorable absorption/desorption properties, while a thicker coating (larger t) is less mechanically robust but has better absorption/desorption properties. In various aspects, acoustically active coating 514 can have a thickness tin the micron range, for instance 40-60 microns.

FIG. 6 illustrates an aspect of a process 600 for making a back volume with at least one surface coated with an acoustically active coating, as shown FIG. 4, using an apparatus such as is shown in FIG. 5. The process starts at block 602.

At block 604, an aqueous slurry or suspension (i.e., a semiliquid mixture of fine particles suspended in a solvent, in this case water) is formed by combining an adsorptive/desorptive substance such as a zeolite, a solvent, and a binder. The binder can be a polyacrylic or polyurethane emulsion. At block 606 the resulting slurry is mechanically stirred until thoroughly mixed and at block 608 the slurry is sieved or filtered to remove agglomerated particles, if any. The sieved/filtered slurry is then put into the slurry reservoir 508 of sprayer 505 and at block 610 the sprayer is positioned within environment 502 at the desired distance D from substrate 512 on which the acoustically active coating 514 is to be formed. At block 612 slurry reservoir 508 is pressurized so that slurry is forced through nozzle 506, where it is atomized (i.e., broken up into droplets of slurry) and ejected from the nozzle as a slurry spray.

At block 614 the slurry sprayed from nozzle 506 is directed onto the substrate 512 to form layer 514. At block 616 the process checks whether the current thickness of layer 514 matches the desired thickness. If at block 616 the current thickness is less than the desired thickness, the process returns to block 614 where it continues spraying slurry onto substrate 512. But if at block 616 the thickness of layer 514 is substantially equal to the desired thickness, then the process moves to block 618, where spraying stops, and then to block 620 where coating 514 is dried to form slurry layer 514 into an acoustically active coating 514. In one aspect layer 514 might require no drying at all after spraying, but in aspects where it requires drying it can be allowed to dry naturally in the environmental conditions of environment 502. In still other aspects, additional measures can be taken to dry layer 514 into acoustically active coating 514, such as blowing heated or unheated air over or on it, placing substrate 512 and coating 514 in an oven for a period of time, etc. Once coating 514 is dry and fixed on substrate 512, at block 622 the substrate/coating combination can be formed, for instance by bending, into a loudspeaker back volume that will have at least one interior surface coated with acoustically active coating 514. The process ends at block 624.

PROCESS EXAMPLES

Specific examples of blocks within process 600 are given in examples 1-5 below; examples 1-4 below describe the preparation of acoustical active coatings, example 5 describes the preparation of a cross section of an acoustically active coating for SEM investigation. Examples 6-7 describe analyses of coatings obtained using the slurry of example 1.

Table 1 below gives an overview of compositions of coatings obtained in examples 1-4. For the aspects shown in Table 1, the acoustically active coating has a composition with between 5% and 10% by mass of binder and between 90% and 95% by mass of an adsorptive/desorptive substance, in this case a zeolite. But other aspects can use different mass percentages of binder and adsorptive/desorptive substance. For instance, other aspects can include between 2% and 30% by mass of binder and between 70% and 98% by mass of adsorptive/desorptive substance. Other aspects can include additional materials besides a binder and an adsorptive/desorptive substance, and still other aspects need not use zeolite as an adsorptive/desorptive substance.

TABLE 1

Coating Compositions

| Example No. | Mass Fraction Zeolite | Mass Fraction Binder | Mass Fraction KOH |
|---|---|---|---|
| 1 | 94.7% | 5% | 0.4% |
| 2 | 91.6% | 8% | 0.4% |
| 3 | 94.7% | 5% | 0.4% |
| 4 | 91.6% | 8% | 0.4% |

Example 1

A binder comprising 8.64 g acrylic emulsion (28% solids content), 41.2 g deionized water, 1 g aqueous potassium hydroxide (KOH) (4 M) solution, and 46 g MFI zeolite were placed in a 100 ml beaker. The slurry was stirred for 3 minutes and sieved (mesh size 100 μm) to remove agglomerates. An airbrush pistol with a 0.5 mm nozzle was filled with the slurry and the slurry was then sprayed onto an acoustic fixture with an applied pressure of 2 bar and a spraying distance D of about 15-20 cm so that the resulting coating appeared dry by eye inspection. Acoustic characteristics of the fixture were measured before and after the application of the coating.

Example 2

The setup was the same as in Example 1, but the composition of the suspension was changed to 14.3 g acrylic emulsion (solids content 28%), 38.7 g deionized water, 1 g KOH (4 M) and 46 g MFI zeolite.

Example 3

The setup was the same as in example 1, but the composition of the suspension was changed to 6.05 g acrylic emulsion (solids content 40%), 43.79 g deionized water, 1 g aqueous KOH (4 M) solution and 46 g MFI zeolite.

Example 4

The setup was the same as in example 1, but the composition of the suspension was changed to 10 g acrylic emulsion (solids content 40%), 41.2 g deionized water, 1 g aqueous KOH (4 M) solution and 46 g MFI zeolite.

Example 5

The suspension of example 1 was sprayed onto an SEM sample carrier with a flat surface. 500 mg Isophoronediamine and 600 mg Trimethylolpropane triglycidyl ether were mixed and stirred for 30 seconds. The two compounds are standard materials forming an epoxy resin after curing. Four drops of the mixture were applied on the zeolite coating on the sample carrier which was then cured at 50° C. for 2 hours. The cured epoxy coating was cut and the cross section was analyzed with a scanning electron microscope (SEM).

The average thickness of the coating obtained in example 1 was calculated by measuring the thickness at six points P1-P6 in each of three regions of the coating and calculating the mean value and the standard deviation. The values obtained are shown in Table 2 below. Average thickness was calculated to 58.8±19.5 μm. Mass and area of the coating were 3.2 mg and 1.13E-4 $m^2$. Density was calculated by these values to be 481 $kg/m^3$.

TABLE 2

Measured thickness of coatings at different points

| Region No. | Thickness (μm) | P1 (μm) | P2 (μm) | P3 (μm) | P4 (μm) | P5 (μm) | P6 (μm) |
|---|---|---|---|---|---|---|---|
| 1 | 56.6 | 56.6 | 47.7 | 52.4 | 30.4 | 61.2 | 57.0 |
| 2 | 71.8 | 71.8 | 76.8 | 83.1 | 75.3 | 81.5 | 76.1 |
| 3 | 39.2 | 37.7 | 18.1 | 84.1 | 30.9 | 75.4 | 50.5 |

Since the composition of the slurries in examples 1-4 varies only by about 2% in solid content, it was assumed that the density of coatings obtained by these slightly different slurry compositions does not differ more than 2% from the value obtained here.

Example 6

The suspension from example 1 was sprayed onto an acrylic glass plate with an airbrush pistol with 0.5 mm nozzle. The acoustically beneficial coating formed was carefully scraped off the plate with a scalpel blade and collected. The procedure was repeated until an amount of 1 g had been gathered. The porosity of the material was determined by a mercury sorption measurement.

Example 7

Suspension from example 1 was poured on an acrylic glass plate and dried at 60° C. The layer was carefully scraped off the plate with a scalpel blade and collected. A similar layer did not show a beneficial acoustical effect. The procedure was repeated until an amount of 1 g had been gathered. The porosity of the material was determined by a mercury sorption measurement.

Results

Figure 7:
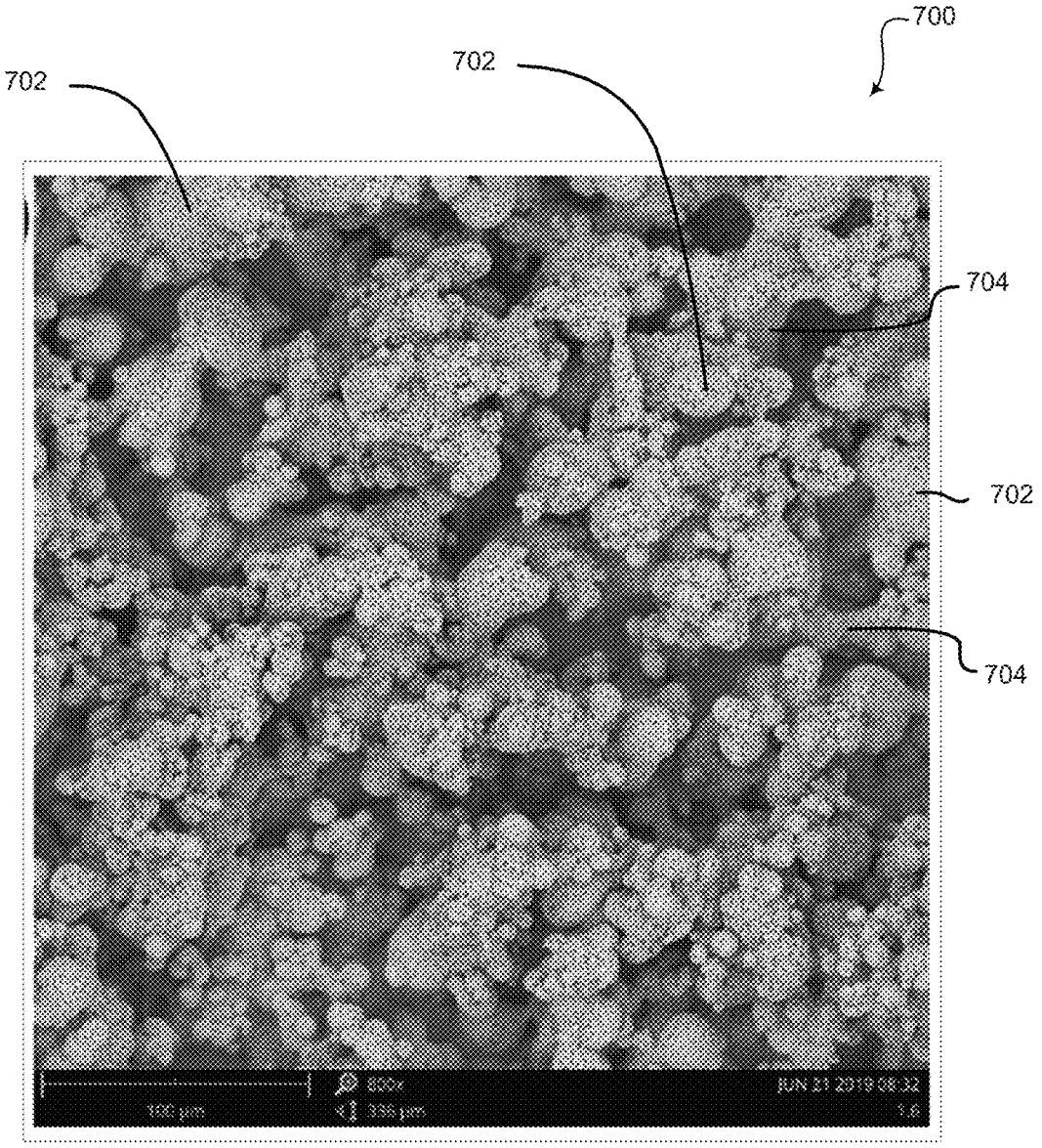
FIG. 7 is a scanning electron microscope (SEM) photograph of an aspect of a coating resulting from the process shown in FIGS. 5-6.
Figure 9:
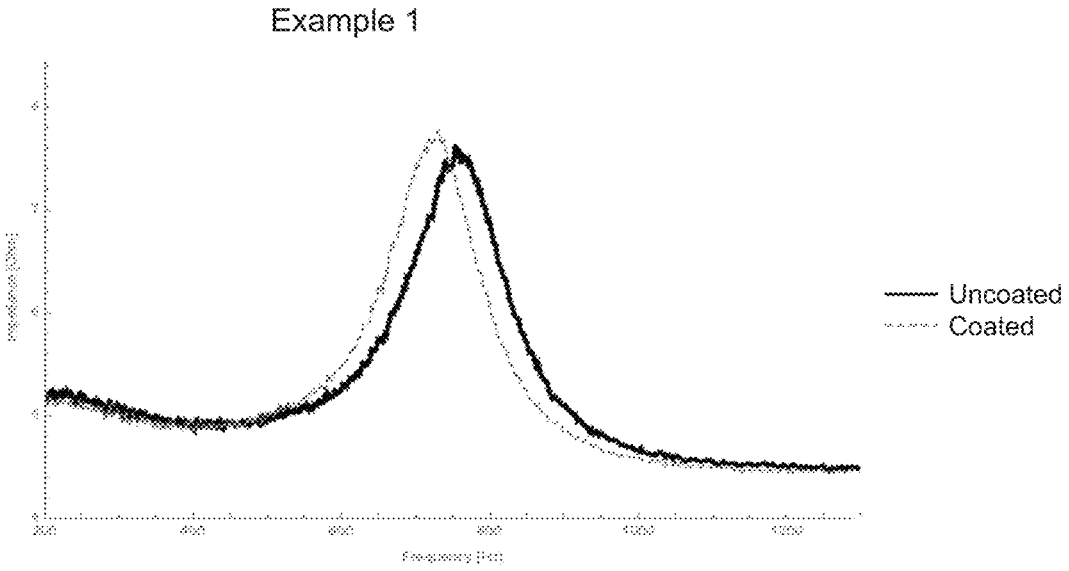
FIGS. 9-12 are graphs illustrating the shift in resonance frequency produced by the acoustically active coatings described in connection with examples 1-4, respectively.
Figure 10:
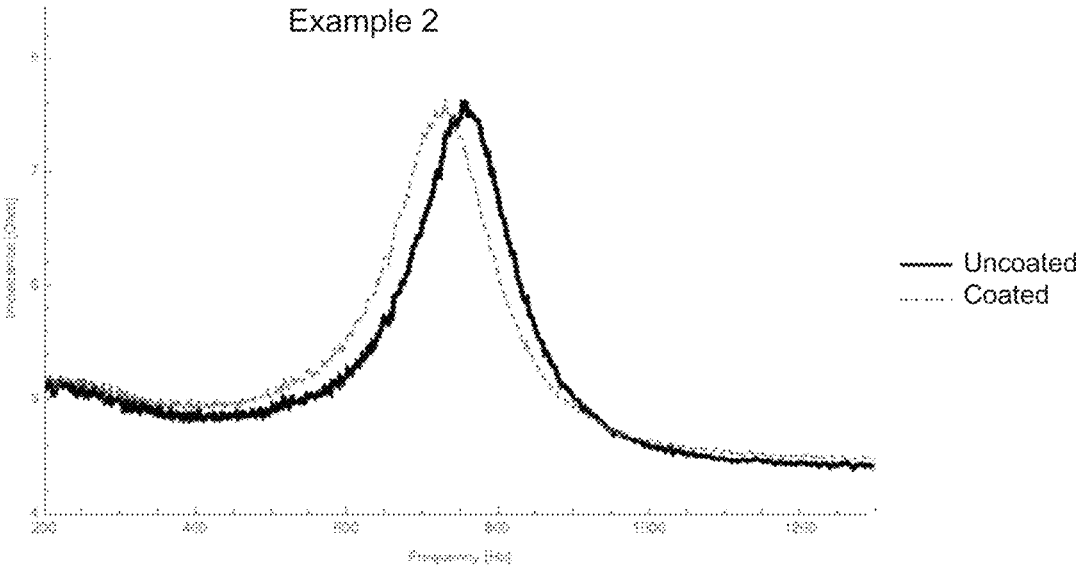
Figure 11:
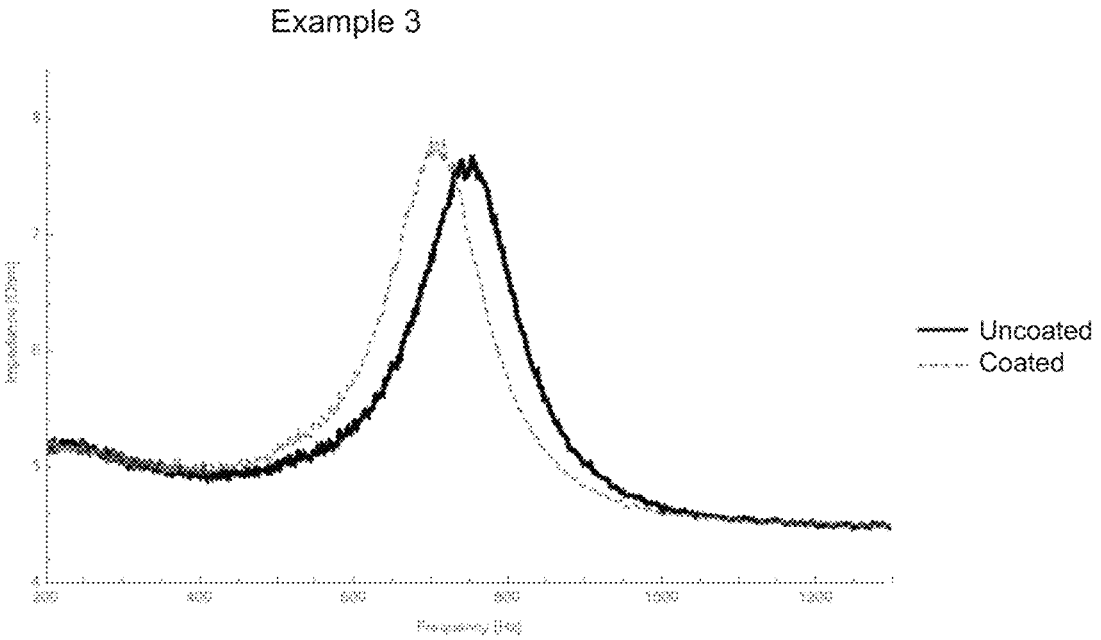
Figure 12:
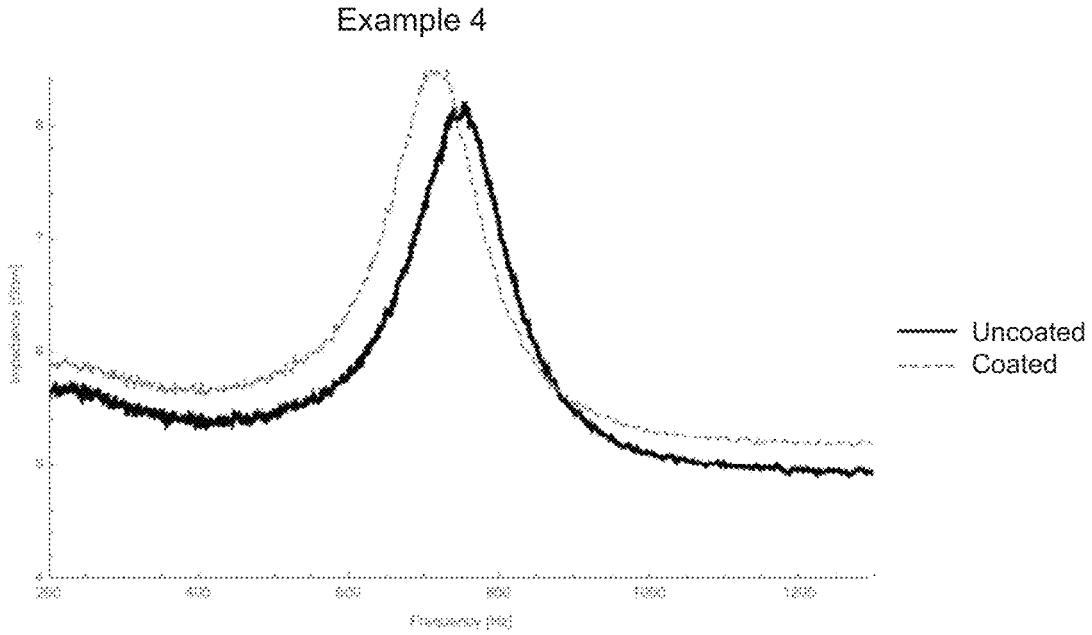

FIG. 7 illustrates an aspect of an acoustically active highly porous coating that results from using a slurry such as the one in example 1 with a process such as the one shown in FIGS. 5-6. Viewed at a macro level—that is, viewed with the unaided eye or at low-magnifications—the acoustically active coating appears smooth and monolithic, with no voids. But when viewed at high magnification, as shown in the SEM photograph of FIG. 7, it becomes clear that the resulting coating is a highly porous coating. The coating is described as a highly porous coating because it includes numerous pore sizes within a wide range of pore diameters (see FIG. 9). The International Union of Pure and Applied Chemistry (IUPAC) defines micropores as pores comprising diameters from 0-2 nm, mesopores comprising diameters from 2-50 nm and macropores comprising diameters above 50 nm. The coating of FIG. 7 is at least microporous because the zeolite used (the adsorptive/desorptive material) contains micropores, but the coating is described herein as highly porous because it includes a broad range of pore diameters, from micropores through mesopores to macropores. The porosity of the coating increases the effective surface area of the coating, hence exposing more of the adsorbent material, a zeolite in this aspect, to gases in a back volume and allowing better adsorption/desorption of those gases.

Highly porous coating 700 can be described various ways. One description is that it is an irregular matrix of convex shapes 702—irregular because the sizes and exact shapes of the convex shapes, and their spacing in the matrix, are both non-uniform. In the illustrated aspect the convex shapes 702 are irregularly joined to each other by concave connectors 704 to create the irregular matrix. As can be seen in FIG. 7, the irregular matrix—highly irregular in the illustrated aspect—means that there is a large range and non-uniform distribution of pore sizes (see FIG. 8). Considering the process 600 by which it can be made, microporous coating 700 can also be described as a matrix or collection of spheroidal droplets and deformed droplets, both of different sizes, joined to each other. The microscopic appearance of the coating shown in FIG. 7 has various analogs in natural or biological structures. For instance, the appearance of the highly porous coating 700 is reminiscent of some types of coral or some fungi. The microscopic appearance also has analogs in other human-produced structures. Sintered metals can have a similar appearance, as can agglomerations within otherwise powdered materials.

Figure 8:
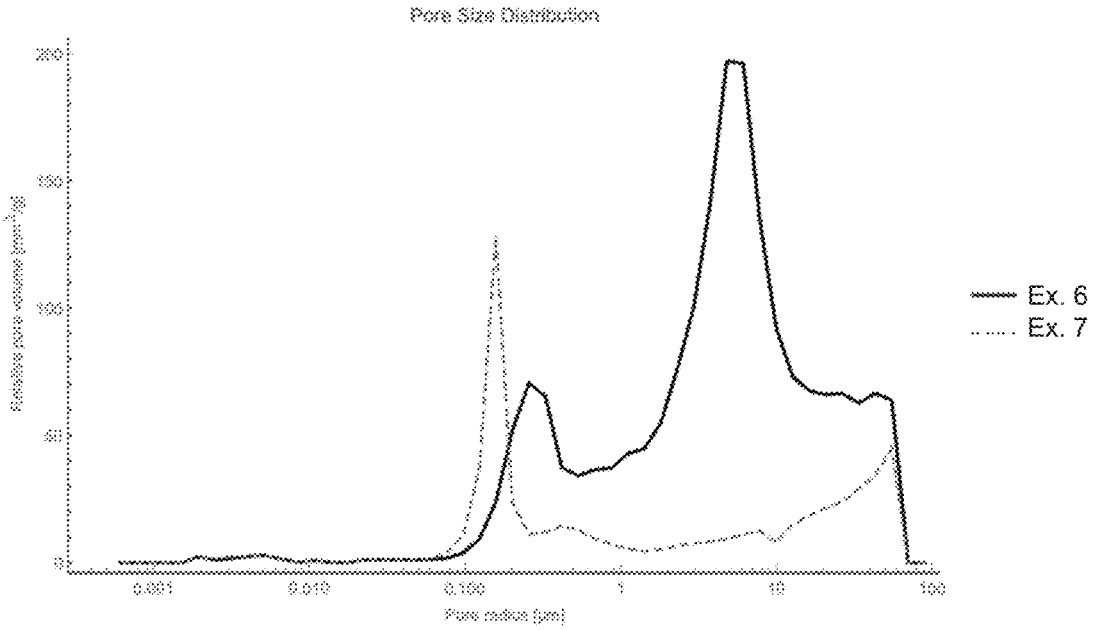
FIG. 8 is a graph illustrating the distribution of pore sizes measured in a sample coating prepared according to example 1.

FIG. 8 illustrates graphically the results of the porosity measurements obtained for examples 6 and 7. The graph shows the pore radius in microns plotted against the pore volume in cubic millimeters per gram of coating. Because the highly porous coating is an irregular matrix, the pores in the matrix can be expected to be of different sizes, sometimes of vastly different sizes depending on the aspect. And that is what appears in the highly porous coatings shown in the graph: there is a distribution of pore sizes ranging from below 0.3 nm to about 100 microns. For the aspect of example 6, most of the pore sizes are between 100 nm (0.1 microns) and 100 microns, with a peak around the 6-8 micron range. For the aspect of example 7, the peak number of pores have dimensions around 100 nm (0.1 microns). The cumulative pore volume for sample obtained in experiment 6 between 1 and 20 μm radius is 1290 $mm^3/g$. The cumulative pore volume for sample obtained in example 7 between 1 and 20 μm radius is 134 $mm^3/g$; in other words, the coating obtained from example 6 is much more porous than the coating obtained from example 7.

FIGS. 9-12 graphically illustrate the resonance frequency results of the disclosed acoustically active highly porous coatings. The figures are, respectively, graphs the electrical impedance plotted against the frequency of a loudspeaker module with the coatings of examples 1-4. As can be seen, in every illustrated aspect there is a downward shift in resonance frequency, which translates into an improvement in acoustic performance of the speaker, especially at lower frequencies.

Table 3 below summarizes the results that are illustrated graphically in FIGS. 9-12, comparing the acoustic resonance frequencies of an uncoated back volume and an aspect of a zeolite-coated back volume. The table also provides other data about the coating, including its mass and thickness calculated by density. The thickness of a specific coating was calculated by measuring the mass of the coating and using the average density determined in description of example 5 and the known substrate surface area of 1.39E-3 $m^2$.

TABLE 3

Overview of Coatings, Thickness and Shift of Resonance Frequencies.

| Coating of Example No. | Mass | Thickness calculated by Density | Resonance Frequency Uncoated/ Coated | Resonance Frequency Shift |
|---|---|---|---|---|
| 1 | 40.6 mg | 59.2 μm | 750 Hz/718 Hz | 32 Hz |
| 2 | 39.0 mg | 56.9 μm | 751 Hz/721 Hz | 30 Hz |
| 3 | 34.4 mg | 50.2 μm | 742 Hz/703 Hz | 39 Hz |
| 4 | 29.9 mg | 43.6 μm | 740 Hz/709 Hz | 31 Hz |

All coatings show a significant shift of the resonance frequency to lower regions, thus improving sound quality of loudspeakers.

The above description of aspects is not intended to be exhaustive or to limit the invention to the described forms. Specific aspects of, and examples for, the invention are described herein for illustrative purposes, but various modifications are possible. To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. An audio speaker comprising:

a housing defining a back volume behind a speaker driver, wherein the speaker driver can convert an electrical audio signal into a sound so that the sound can propagate through a gas in the back volume; and a porous acoustically active coating deposited on at least one interior surface of the back volume, the porous acoustically active coating including convex particles connected by concave connectors, the convex particles and concave connectors being made of a binder and an adsorptive substance.

2. The audio speaker of claim 1 wherein the porous acoustically active coating has pore sizes between 0.3 nanometers and 100 microns.

3. The audio speaker of claim 2 wherein a largest proportion of the pore sizes are between 0.1 microns and 100 microns.

4. The audio speaker of claim 1 wherein the acoustically active coating comprises between 2% and 30% by mass of binder and between 70% and 98% by mass of zeolite.

5. The audio speaker of claim 4 wherein the acoustically active coating comprises between 5% and 10% by mass of binder and between 90% and 95% by mass of zeolite.

6. The audio speaker of claim 1 wherein a thickness of the porous coating is between 40 microns and 60 microns.

7. The audio speaker of claim 1 wherein the adsorptive substance is a zeolite.

8. A process comprising:

preparing a slurry including a binder and a zeolite;

spraying the slurry through a nozzle having a nozzle diameter; and depositing a porous acoustically active coating on a substrate by directing the sprayed slurry through an environment onto the substrate, the substrate being positioned at a distance from the nozzle, and the coating including convex particles connected by concave connectors.

9. The process of claim 8 wherein the environment has a relative humidity between 40% and 70%.

10. The process of claim 9 wherein the environment is at National Institute of Standards and Technology (NIST) standard temperature and pressure (STP).

11. The process of claim 8 wherein the acoustically active coating comprises between 2% and 30% by mass of binder and between 70% and 98% by mass of zeolite.

12. The process of claim 11 wherein the acoustically active coating comprises between 5% and 10% by mass of binder and between 90% and 95% by mass of zeolite.

13. The process of claim 8 wherein preparing the slurry comprises:

combining the binder, the zeolite, and a solvent;

thoroughly mixing the combined binder, zeolite, and solvent; and sieving the slurry to remove particles exceeding a certain size.

14. The process of claim 8 wherein the distance between the nozzle and the substrate is between 15 and 20 centimeters.

15. The process of claim 8 wherein a thickness of the porous acoustically active coating is between 40 microns and 60 microns.

16. The process of claim 8 wherein the porous acoustically active coating includes pore sizes between 0.3 nanometers and 100 microns.

17. The process of claim 16 wherein a largest proportion of the pore sizes are between 0.1 microns and 100 microns.

18. An electronic device comprising:

an audio speaker comprising:

a housing defining a back volume behind a speaker driver, wherein the speaker driver can convert an electrical audio signal into a sound so that the sound can propagate through a gas in the back volume, and a porous acoustically active coating deposited on at least one interior surface of the back volume, the porous acoustically active coating including convex particles connected by concave connectors, the convex particles and concave connectors being made of a binder and an adsorptive substance; and a processor coupled to the audio speaker and to a memory, the memory having stored therein one or more application programs which include instructions that, when executed by the processor, transmit the electrical audio signals to the audio speaker for transduction into sound.

19. The electronic device of claim 18 wherein the porous acoustically active coating has pore sizes between 0.3 nanometers and 100 microns.

20. The electronic device of claim 19 wherein a largest proportion of the pore sizes are between 0.1 microns and 100 microns.

21. The electronic device of claim 18 wherein a thickness of the porous acoustically active coating is between 40 microns and 60 microns.

22. The electronic device of claim 18 wherein the adsorptive substance is a zeolite.

23. The electronic device of claim 18, further comprising:

a microphone coupled to the processor;

radio frequency (RF) circuitry coupled to the processor; or a display coupled to the processor.

* * * * *